US006830505B2

(12) United States Patent
Moriya et al.

(10) Patent No.: US 6,830,505 B2
(45) Date of Patent: Dec. 14, 2004

(54) POLISHING MACHINE

(75) Inventors: Norihiko Moriya, Nagano (JP); Satoki Kanda, Nagano (JP); Takumi Kobayashi, Nagano (JP); Atsushi Kajikura, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 10/648,680

(22) Filed: Aug. 25, 2003

(65) Prior Publication Data

US 2004/0043713 A1 Mar. 4, 2004

(30) Foreign Application Priority Data

Aug. 29, 2002 (JP) ..... 2002-251381
Aug. 12, 2003 (JP) ..... 2003-292132

(51) Int. Cl.[7] ..... B24B 7/00
(52) U.S. Cl. ..... 451/262; 451/269; 451/270
(58) Field of Search ..... 451/262, 259, 451/269, 270, 271, 272, 261, 264

(56) References Cited

U.S. PATENT DOCUMENTS 6,080,048 A * 6/2000 Kotagiri et al. ..... 451/285
6,113,490 A * 9/2000 Hakomori ..... 451/288
6,206,765 B1 * 3/2001 Sanders et al. ..... 451/56
6,361,418 B1 3/2002 Inada

FOREIGN PATENT DOCUMENTS

JP 2002-36099 2/2002

* cited by examiner

*Primary Examiner*—Dung Van Nguyen
(74) *Attorney, Agent, or Firm*—Jordan and Hamburg LLP

(57) ABSTRACT

The polishing machine is capable of evenly applying a pressing force from an upper polishing plate to work pieces accommodated in through-holes of carriers. The polishing machine comprises: a plurality of the carriers provided around a center of gravity of an upper polishing plate and sandwiched between the polishing plates. Circular motion of the carriers, without revolving, are performed independently. Centers of gravity of the work pieces, which are held by the carriers, are simultaneously moved close to a center of gravity of the upper polishing plate and simultaneously moved away therefrom, and moving distances of the centers of gravity of the work pieces are equal.

19 Claims, 12 Drawing Sheets

POLISHING MACHINE

BACKGROUND OF THE INVENTION

The present invention relates to a polishing machine, more precisely relates to a polishing machine capable of polishing both sides (faces) of work pieces, e.g., silicon wafers, by an upper polishing plate and a lower polishing plate.

A conventional polishing machine for polishing both sides of work pieces, e.g., silicon wafers, is shown in FIG. 16. In FIG. 16, a lower polishing plate 200 and an upper polishing plate 202 are rotated in predetermined directions. Carriers 208, which are driven by an internal gear 204 and a sun gear 206, are provided between the polishing plates 200 and 202. Through-holes (not shown), in each of which a work piece to be polished is held, are bored in the carriers 208. Both sides (faces) of the work pieces held in the through-holes are simultaneously polished by the polishing plates 200 and 202.

The lower polishing plate 200 is mounted on a lower board 209 and rotated together with the lower board 209. The lower board 209 is rotatably mounted on a base 210 with a bearing 212. Torque of an electric motor 214, which rotates the lower board 209, is transmitted to the lower board 209 by transmission gears 216 and a cylindrical shaft 217.

The upper polishing plate 202 is rotated by torque of an electric motor 224, which is transmitted by transmission gears 218 and a shaft 219. The internal gear 204 is rotated by torque of an electric motor 226 by transmission gears 220 and a cylindrical shaft 221. Further, the sun gear 206 is rotated by torque of an electric motor 228 by transmission gears 222 and a shaft 223.

As shown in FIG. 17, a plurality of carriers 208 are mounted on the lower polishing plate 200, and a plurality of the through-holes 230, in which the work pieces will be accommodated and held, are bored in each carrier 208.

Gear teeth for engaging with the internal gear 204 and the sun gear 206 are formed on an outer edge of each carrier 208. By rotating the internal gear 204 and the sun gear 206, the carriers 208 are revolved and orbited around the sun gear 206 by difference of rotational speeds of the two gears 204 and 206.

The carriers 208, in each of which the work pieces are held in the through-holes 230, are sandwiched between the polishing plates 200 and 202, then the polishing plates 200 and 202, the internal gear 204 and the sun gear 206 are respectively rotated at predetermined rotational speeds. The work pieces are revolved and orbited around the sun gear 206 together with the carriers 208, so that the both sides of the work pieces can be polished simultaneously.

However, in the polishing machine shown in FIGS. 16 and 17, each of the carriers 208 is revolved on its own axis, so a peripheral speed of an inner part of the carrier 208 is different from that of an outer part. Further, the work piece held in the through-hole 230 of the carrier 208 is also revolved, so a peripheral speed of an inner part of the work piece is different from that of an outer part.

By the difference of the peripheral speeds of the carrier 208, the work pieces held in the inner part and the outer part of the carrier 208 cannot be polished uniformly, and abrasion spots are sometimes formed in the work pieces. Further, by the difference of the peripheral speeds of the work piece, the inner part and the outer part of each work piece cannot be polished uniformly, and abrasion spots are sometimes formed in the work piece.

Since the gear teeth of the carriers 208 are engaged with the internal gear 204 and the sun gear 206, abrasion dusts formed therebetween stick onto not only the carriers 208 but also polishing faces of the polishing plates 200 and 202.

To solve the above described disadvantages, an improved polishing machine, which is capable of polishing both sides of work pieces without revolving and orbiting carriers, was disclosed in U.S. Pat. No. 6,080,048. It is shown in FIG. 18.

In FIG. 18, an upper polishing plate 302 is rotated by a rotating unit 304 and vertically moved by a lifting unit 306. A lower polishing plate 310 is rotated by a rotating unit 308. One carrier 300 is sandwiched between the polishing plates 302 and 310. A plurality of through-holes 230, in each of which a work piece 100 is accommodated and held, are formed in the carrier 300.

The carrier 300 has a plurality of holes bored along an outer edge. By inserting pins 316, which are upwardly extended from a carrier holder 312, into the holes, the carrier 300 can be attached to the carrier holder 312.

The carrier holder 312 has a circular motion mechanism 320. The circular motion mechanism 320 includes: four bearing sections 318 outwardly extended from an outer circumferential face of the carrier holder 312; cranks respectively provided to the bearing sections 318; and a driving unit 340 capable of synchronously driving the cranks.

Each of the cranks includes: a rotatable eccentric arm 324 formed into a circular disk; and a shaft 322*a* arranged parallel to axial lines of the polishing plates 302 and 310 and having one end attached to the bearing section 318 and the other end eccentrically attached to the circular eccentric arm 324.

The driving unit 340 includes: shafts 322*b*, whose one ends are respectively attached to centers of the circular eccentric arms 324; sprockets 342 respectively attached to the other ends of the shafts 322*b*; a timing chain engaged with the sprockets 342; a gear 346 attached to one of the shafts 322*b*; a gear 350 engaged with the gear 346; and a motor 348 for rotating the gear 350.

In the polishing machine shown in FIG. 18, the polishing plates 302 and 310 are rotated in the predetermined directions by the motor 348 of the circular motion mechanism 320. Therefore, the carrier holder 312 sandwiched between the polishing plates 302 and 310 performs small circular motion, without revolving on its own axis, in a plane including the carrier 300. The peripheral speed differences of the carrier and the work pieces 100, which are caused by revolution of the carrier, can be solved.

Unlike the polishing machine shown in FIGS. 16 and 17, the carrier 300 has no gear teeth engaging with the internal gear and the sun gear. Therefore, no abrasion dusts are formed and stuck onto the carrier 300. Further, no abrasion dusts are stuck onto polishing faces of the polishing plates 302 and 310.

However, in the polishing machine shown in FIG. 18, the center of the carrier 300 is shifted a distance "M" from a coaxial line "L" of the polishing plates 302 and 310. The carrier 300 orbits around the line "L" without revolving its own axis. A radius of the circular orbit motion of the carrier 300 is equal to a distance between the shafts 322*a* and 322*b* (="M").

Since the carrier 300, whose center is shifted the distance "M" from the line "L", performs the circular orbit motion without revolving, centers of gravity of the work pieces held in the through-holes 230 of the carrier 300 are located at different positions with respect to a center of gravity or a center of rotation of the upper polishing plate 302. Accordingly, uneven forces are applied to the work pieces 100 from the polishing plates 302 and 310, vibrations are generated while polishing, and polishing accuracy is lowered.

Since the carrier 300 must be broader than the polishing faces of the polishing plates. 302 and 310, the polishing machine must be large, and its manufacturing cost must be high. Namely, increasing efficiency by large-sized polishing machines is limited.

SUMMARY OF THE INVENTION

An object of the present invention is to provide a compact polishing machine capable of evenly applying a pressing force from an upper polishing plate to work pieces accommodated in through-holes of carriers.

To solve the problems of the conventional polishing machines, the inventors studied and found that polishing efficiency can be improved, without employing the large carrier, by sandwiching a plurality of small carriers, each of which has through-holes for accommodating work pieces, between an upper polishing plate and a lower polishing plate.

Further, they found that small circular motion of the carriers can be performed, without revolving, by independently driving the carriers between the upper polishing plate and the lower polishing plate. By performing the small circular motion, the pressing force can be evenly applied from the upper polishing plate to the work pieces.

To achieve the object, the polishing machine of the present invention has following structures.

Namely, the polishing machine comprises:

an upper polishing plate for polishing upper faces of work pieces;

a lower polishing plate for polishing lower faces of the work pieces;

means for rotating at least one of the polishing plates;

a plurality of carriers being provided around a center of gravity of the upper polishing plate and sandwiched between the polishing plates, each of the carriers having a through-hole, in which the work piece is accommodated;

means for independently performing circular motion or swing motion of the carriers without revolving on their own axes; and means for controlling the performing means, whereby centers of gravity of the work pieces, which are held by the carriers, are simultaneously moved close to a center of gravity of the upper polishing plate and simultaneously moved away therefrom, and moving distances of the centers of gravity of the work pieces are equal while the circular motion or the swing motion of the carriers.

The polishing machine may further comprise means for orbiting the carriers round a rotational axis of the lower polishing plate, and the rotating means may rotate the both of said polishing plates. With this structure, accuracy of polishing the work pieces can be improved, the work pieces can be fed and taken out at fixed place or places, and the work pieces can be automatically fed and taken out by a robot, etc.

Another polishing machine comprises:

a fixed upper polishing plate for polishing upper faces of work pieces;

a rotatable lower polishing plate for polishing lower faces of the work pieces;

means for rotating the lower polishing plate;

a plurality of carriers being provided around a center of gravity of the upper polishing plate and sandwiched between the polishing plates, each of the carriers having a through-hole, in which the work piece is accommodated;

means for independently performing circular motion or swing motion of the carriers without revolving on their own axes;

means for orbiting the carriers round a rotational axis of the lower polishing plate; and means for controlling the performing means, whereby centers of gravity of the work pieces, which are held by the carriers, are simultaneously moved close to a center of gravity of the upper polishing plate and simultaneously moved away therefrom, and moving distances of the centers of gravity of the work pieces are equal while the circular motion or the swing motion of the carriers.

In the polishing machine, the performing means may be located close to the lower polishing plate; and connecting sections, which are respectively formed in extended sections of the carriers projected from an outer edge of the lower polishing plate, may be respectively connected with connecting members of the performing means. With this structure, the circular motion or the swing motion of the carriers can be performed without revolving on their own axes.

In the polishing machine, the lower polishing plate may have a donut-shape with a center hole; a couple of the performing means may be respectively located close to an inner circumferential face of the center hole of the lower polishing plate and an outer circumferential face of the lower polishing plate; and connecting sections, which are formed in the carriers and located close to the inner circumferential face and the outer circumferential face of the lower polishing plate, may be respectively connected with connecting members of the performing means. With this structure, the circular motion or the swing motion of the carriers can be easily performed without revolving on their own axes.

In the polishing machine, the performing means may include eccentric arms, which are rotatable and in each of which a connecting pin connected with the carrier is eccentrically provided. With this structure, the circular motion or the swing motion of the carriers can be easily performed without revolving on their own axes.

In the polishing machine, the performing means may includes: eccentric arms, which are rotatable and in each of which a first connecting pin connected with the carrier is eccentrically provided; and swing arms, which are swingable and in each of which a second connecting pin is connected with the carrier at a position separated from the first connecting pin. With this structure, the swing motion of the carriers can be performed.

In the polishing machine, phases of the circular motion or the swing motion of the carriers provided to the lower polishing plate may be same, or an even number of the carriers may be provided to the lower polishing plate and the phases of the circular motion or the swing motion of the adjacent carriers may be shifted 180 degrees. With this structure, pressing force can be evenly applied from the upper polishing plate to the work pieces held or accommodated in the through-holes of the carriers.

In the polishing machine, each of the carriers may have a plurality of the through-holes. Further, each of the carriers may be formed into a diamond shape or a sector shape.

In the polishing machine of the present invention, a plurality of the carriers, which hold the work pieces, are sandwiched between the upper polishing plate and the lower polishing plate, so small-sized carriers may be employed. Therefore, a compact polishing machine, whose size is not limited by carriers, can be realized.

Further, the control means controls the performing means to simultaneously move the centers of gravity of the work pieces close to the center of gravity of the upper polishing plate and to simultaneously move the same away therefrom, and to make the moving distances of the centers of gravity of the work pieces equal while the circular motion or the swing motion of the carriers. With this control, a pressing force can be evenly applied from the upper polishing plate to the work pieces held or accommodated in the through-holes of the carriers. Therefore, accuracy of polishing the work pieces can be improved.

Especially, in the case of orbiting the carriers around a rotational axis of the lower polishing plate, the polishing accuracy can be further improved.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
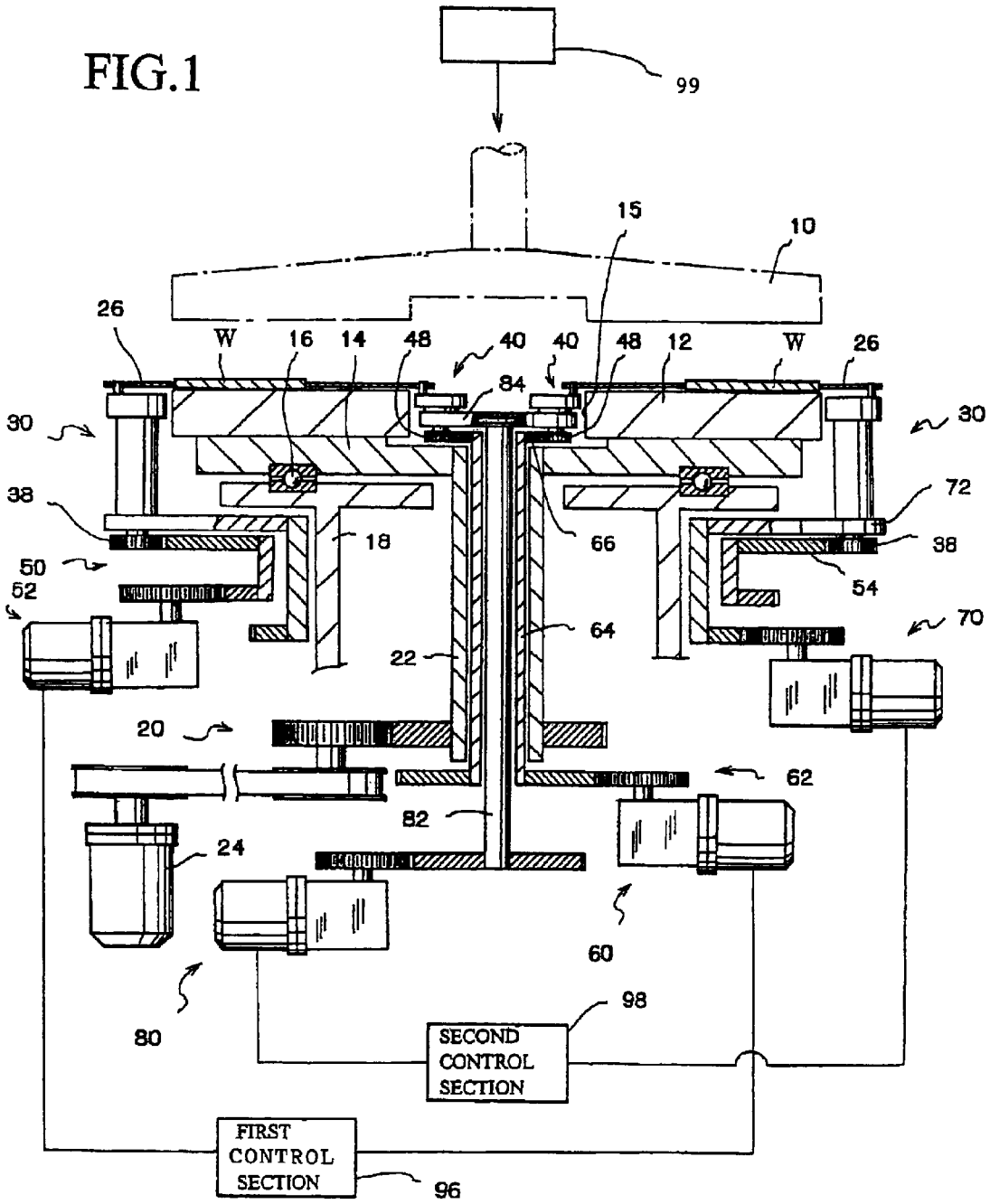
FIG. 1 is a schematic view of a polishing machine of an embodiment the present invention.

A polishing machine of an embodiment the present invention is shown in FIG. 1. The polishing machine has an upper polishing plate 10, which rotates in a prescribed direction, and a lower polishing plate 12, which is formed into a donut shape. The lower polishing plate 12 is mounted on a lower board 14. With this structure, the lower polishing plate 12 is rotated together with the lower board 14 when the lower board 14 is rotated. The lower board 14 is rotatably mounted on a base 18 with a bearing 16. Torque of an electric motor 24, which rotates the lower board 14, is transmitted to the lower board 14 by transmission gears 20 and a cylindrical shaft 22. In FIG. 1, the torque of the motor 24 is transmitted to the gears 20 by a belt.

The upper polishing plate 10 is rotated by an electric motor 99 and vertically moved by a proper unit, e.g., a cylinder unit.

Figure 2A:
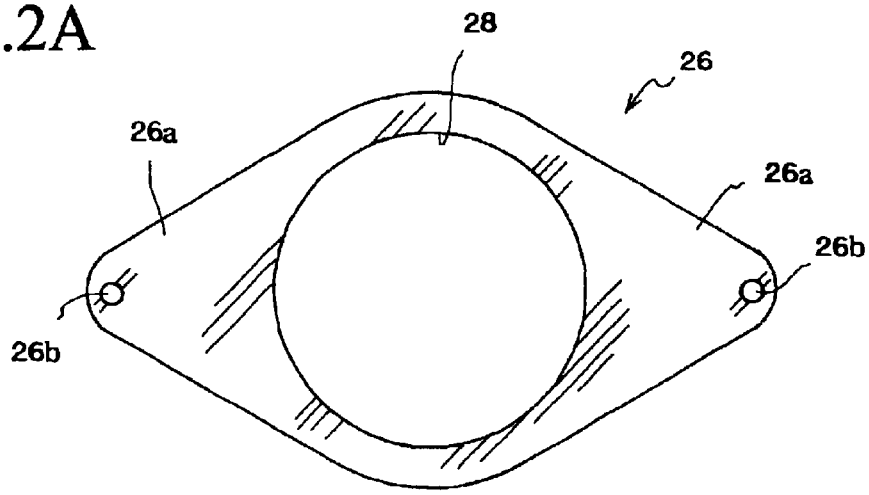
FIG. 2A is a front view of a carrier employed in the polishing machine shown in FIG. 1.
Figure 2B:
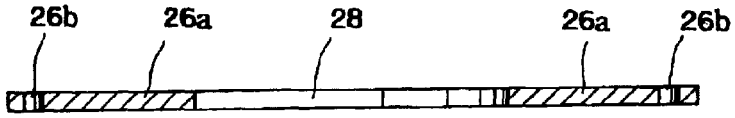
FIG. 2B is a sectional view of the carrier employed in the polishing machine shown in FIG. 1.

In FIG. 1, a plurality of carriers 26 for holding work pieces "W" are mounted on the donut-shaped lower polishing plate 12 having a center hole 15. As shown in FIGS. 2A and 2B, the carrier 26 is formed into a diamond shape and made of epoxy resin including glass fibers as a reinforcing material. A through-hole 28 for accommodating and holding the work piece "W" is formed at a center of the carrier 26. Extended sections 26*a* are rightwardly and leftwardly extended from the through-hole 28, and they are projected from an inner edge of the center hole 15 and an outer edge of the lower polishing plate 12. Small holes 26*b* are respectively formed at outer end parts of the extended sections 26*a*. The small holes 26*b* act as connecting sections, which are connected with a pair of means 30 and 40 for performing circular motion or swing motion of the carriers 26.

Figure 3:
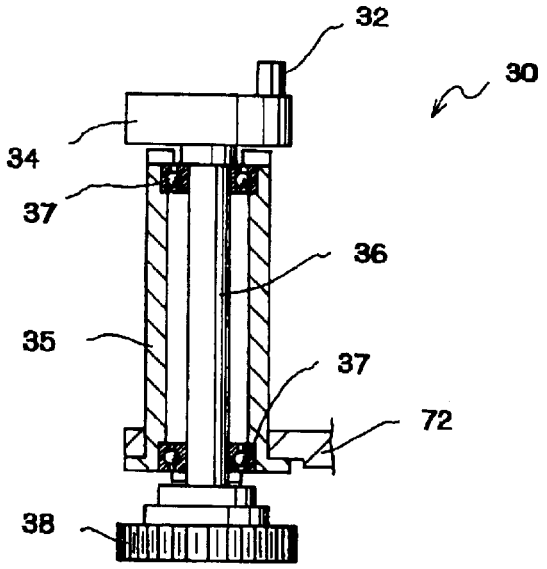
FIG. 3 is a sectional view of one of performing means employed in the polishing machine shown in FIG. 1.

The performing means 30 is located close to an outer circumferential face of the lower polishing plate 12 (see FIG. 1). As shown in FIG. 3, the performing means 30 includes: an eccentric arm 34; a connecting pin 32 eccentrically provided in one face of the eccentric arm 34; a rotary shaft 36 having one end fixed at a center of the other face of the eccentric arm 34 and being inserted in a cylindrical casing 35 with bearings 37; and a gear 38 fixed to the other end of the rotary shaft 36. The connecting pin 32 of the performing means 30 is inserted into one of the small holes 26*b* of the carrier 26 (see FIGS. 2A and 2B).

Figure 4:
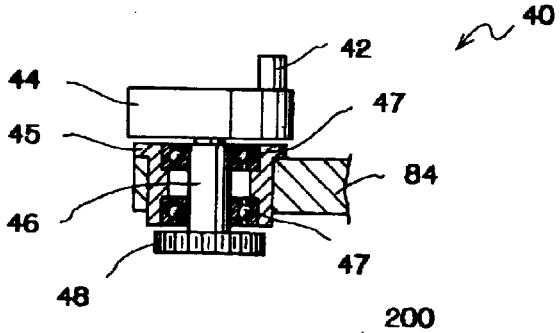
FIG. 4 is a sectional view of the other performing means employed in the polishing machine shown in FIG. 1.
Figure 17:
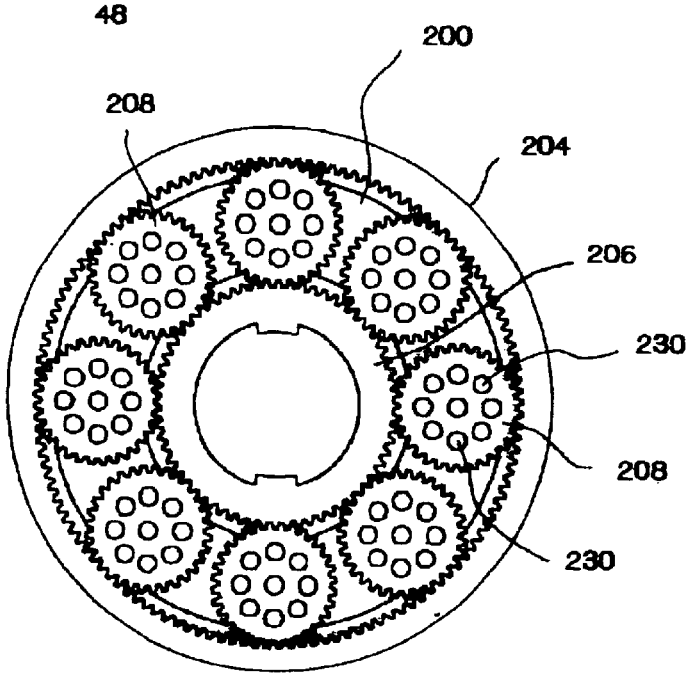
FIG.17 PRIOR ART
FIG. 17 is a front view of the carriers provided on the lower polishing plate of the conventional polishing machine.

The performing means 40 is located close to an inner circumferential face of the center hole 15 of the lower polishing plate 12 (see FIG. 1). As shown in FIG. 4, the performing means 40 includes: an eccentric arm 44; a connecting pin 42 eccentrically provided in one face of the eccentric arm 44; a rotary shaft 46 having one end fixed at a center of the other face of the eccentric arm 44 and being inserted in a cylindrical casing 45 with bearings 47; and a gear 48 fixed to the other end of the rotary shaft 46. The connecting pin 42 of the performing means 40 is inserted into the other small hole 26*b* of the carrier 26 (see FIGS. 2A and 2B).

Figure 5:
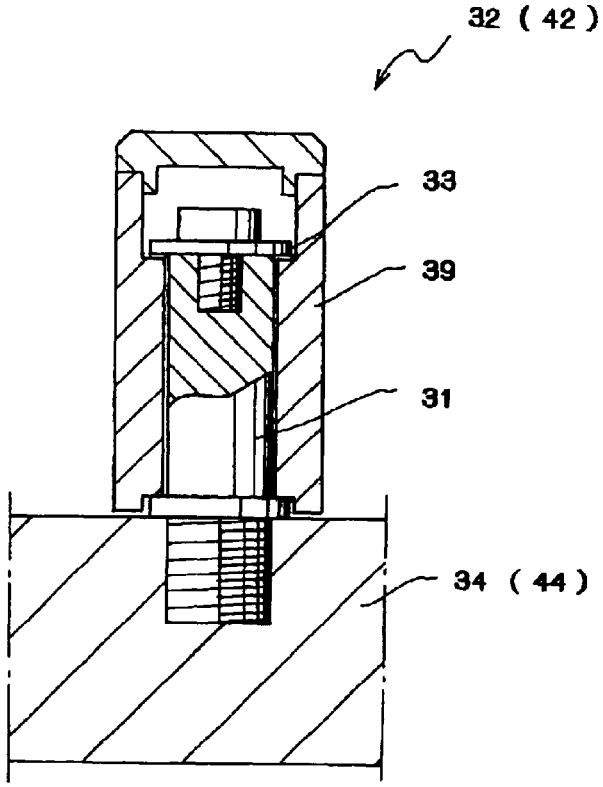
FIG. 5 is a partial sectional view of a extended from an eccentric arm.

As shown in FIG. 5, the connecting pin 32 (42), which is vertically extended from the eccentric arm 34 (44) of the performing means 30 (40), comprises: a vertical screw 31 fixed to the eccentric arm 34 (44); a cap member 39 rotatably covering the vertical screw 31; and a flange 33 fixed to the vertical screw 31 so as to limit a movement of the cap member 39 in the axial direction thereof.

As shown in FIG. 1, a pair of the performing means 30 and 40 are provided for each carrier 26 mounted on the lower polishing plate 26. A plurality of the performing means 30 are located close to the outer circumferential face of the lower polishing plate 12 and arranged along the outer edge thereof.

The gears 38 of the performing means 30 are engaged with a gear 54 of a transmission mechanism 50, which transmits torque of a servo motor 52 to the gears 38. With this structure, rotational directions and rotational speeds of the eccentric arms 34 of the performing means 30 can be synchronized by the servo motor 52.

A plurality of the performing means 40 are located close to the inner circumferential face of the center hole 15 of the lower polishing plate 12 and arranged along the inner edge thereof.

The gears 48 of the performing means 40 are engaged with a gear 66 via a transmission mechanism 62 and a cylindrical shaft 64, which transmits torque of a servo motor 60 to the gears 48. With this structure, rotational directions and rotational speeds of the eccentric arms 44 of the performing means 40 can be synchronized by the servo motor 60.

A first control section 96 controls the servo motors 52 and 60 so as to rotate the eccentric arms 34 of the performing means 30, which are synchronized by the gear 54, and the eccentric arms 44 of the performing means 40, which are synchronized by the gear 66, in the same rotational direction at the same rotational speed.

In FIG. 1, a plurality of the performing means 30, which are arranged along the outer edge of the lower polishing plate 12, are fixed to a plate 72, which is rotated by a servo motor 70. With this structure, the performing means 30 moves along the outer edge of the circular lower polishing plate 12 together with the plate 72 when the servo motor 70 is turned on.

A plurality of the performing means 40, which are arranged along the inner edge of the center hole 15 of the lower polishing plate 12, are fixed to a plate 84, which is fixed to an upper end of a shaft 82 rotated by a servo motor 80. With this structure, the performing means 40 moves along the inner edge of the circular lower polishing plate 12 together with the plate 84 when the servo motor 80 is turned on.

A second control section 98 controls the servo motors 70 and 80 so as to orbit the carriers 26, in each of which the connecting pins 32 and 42 of the eccentric arms 34 and 44 of the performing means 30 and 40 have been inserted in the small holes 26*b*, round the rotational axis of the lower polishing plate 12.

In the polishing machine shown in FIG. 1, the upper polishing plate 10 and the lower polishing plate 12 are rotated in the prescribed directions, thus the carriers 26 are orbited round the rotational axis of the lower polishing plate 12 so as to improve accuracy of polishing the work pieces "W" held by the carriers 26. Note that, if the improvement of polishing accuracy is not required, the orbital movement of the carriers 26 may be omitted.

In the case of polishing without orbiting the carriers 26, the carriers 26 may be orbited so as to adjust positions of the carriers 26 after completion of the polishing work. By adjusting the positions of the carriers 26, the polished work pieces "W" can be positioned at predetermined positions together with the carriers 26, so that the polished work pieces "W" can be automatically taken out from the carriers 26 and other work pieces to be newly polished can be automatically set in the carriers 26 by an automatic mechanism, e.g., a robot.

The upper polishing plate 10 applies a pressing force to the work pieces "W", which have been accommodated and held in the through-holes 28 of the carriers 26 and sandwiched between the polishing plates 10 and 12. Therefore, concave sections, which correspond to the performing means 40 arranged along the inner edge of the lower polishing plate 12, are formed in the upper polishing plate 10.

The control section 96 controls the servo motors 52 and 60 so as to rotate the eccentric arms 34 of the performing means 30 and the eccentric arms 44 of the performing means 40 in the same direction at the same rotational speed.

Since the connecting pins 32 and 42 of the eccentric arms 34 and 44 of the performing means 30 and 40 are inserted in the small holes 26*b* of each carrier 26, each carrier 26 can be moved to perform small circular motion without revolving on its own axis.

In the polishing machine shown in FIG. 1, the carriers 26 are mounted on the lower polishing plate 12 and arranged to enclose a center of gravity (mass) of the upper polishing plate 10. Each carrier 26 is connected with each pair of the performing means 30 and 40 by inserting the connecting pins 32 and 34 of the eccentric arms 34 and 44 into the small holes 26*b*, and distances from the center of gravity of the upper polishing plate 10 to centers of gravity of the work pieces "W" held in the through-holes 28 of the carriers 26 are equal.

The first control section 96 controls the servo motors 52 and 60 so as to rotate the eccentric arms 34 and 44 of the performing means 30 and 40, so that small circular motion of the carriers 26 without revolving their own axes can be performed in the same direction at the same rotational speed.

While the small circular motion of the carriers 26 without revolution, the carriers 26 are simultaneously moved close to the center of gravity of the upper polishing plate 10 and simultaneously moved away therefrom, and moving distances of the carriers 26 are equal, so that centers of gravity of the work pieces "W", which are held by the carriers 26, are simultaneously moved close to the center of gravity of the upper polishing plate 10 and simultaneously moved away therefrom, and moving distances of the centers of gravity of the work pieces "W" are equal. Namely, distances from the center of gravity of the upper polishing plate 10 from the centers of gravity of the work pieces "W" are always equal.

Note that, the electric motors 24 and 25 are controlled by other control sections (not shown) separated from the control sections 96 and 98.

Next, action of the five carriers 26 mounted on the lower polishing plate 12 will be explained with reference to FIGS. 6, 7A and 7B.

The five carriers 26 are provided on the lower polishing plate 12 and arranged to enclose the center of gravity of the upper polishing plate 10. The carriers 26 are shown in FIGS. 2A and 2B, and the work pieces "W" are respectively accommodated and held in the through-holes 28. As shown in FIG. 6, the connecting pin 32 and 42 of the eccentric arms 34 and 44 of the performing means 30 and 40 are respectively inserted in the small holes 26*a* of the carriers 26. Since the carriers 26 are connected with the performing means 30 and 40 by the connecting pins 32 and 42, the distances from the center of gravity of the upper polishing plate 10 to the centers of gravity of the work pieces "W" held by the carriers 26 are equal.

By moving the upper polishing plate 10 downward, the work pieces "W" held by the carriers 26 are sandwiched between the upper polishing plate 10 and the lower polishing plate 12. When the motor 24 is started, the lower polishing plate 12 is rotated in a direction "A", and the upper polishing plate 10 is rotated in a prescribed direction.

Simultaneously, the servo motors 52 and 60 are started so as to rotate the eccentric arms 34 and 44 of the performing means 30 and 40 in the same direction.

Since the gears 38 of the eccentric arms 34 of the performing means 30, which are located close to the outer circumferential face of the lower polishing plate 12, are engaged with the gear 54 rotated by the motor 52, the eccentric arms 34 are synchronously rotated in a direction indicated by arrows.

Since the gears 48 of the eccentric arms 44 of the performing means 40, which are located close to the inner circumferential face of the lower polishing plate 12, are engaged with the gear 66 rotated by the motor 60, the eccentric arms 44 are synchronously rotated in a direction indicated by arrows.

Since the motors 52 and 60 are controlled by the first control sections 96, the eccentric arms 34 and 44 of each carrier 26 can be rotated in the same direction at the same rotational speed.

Figure 6:
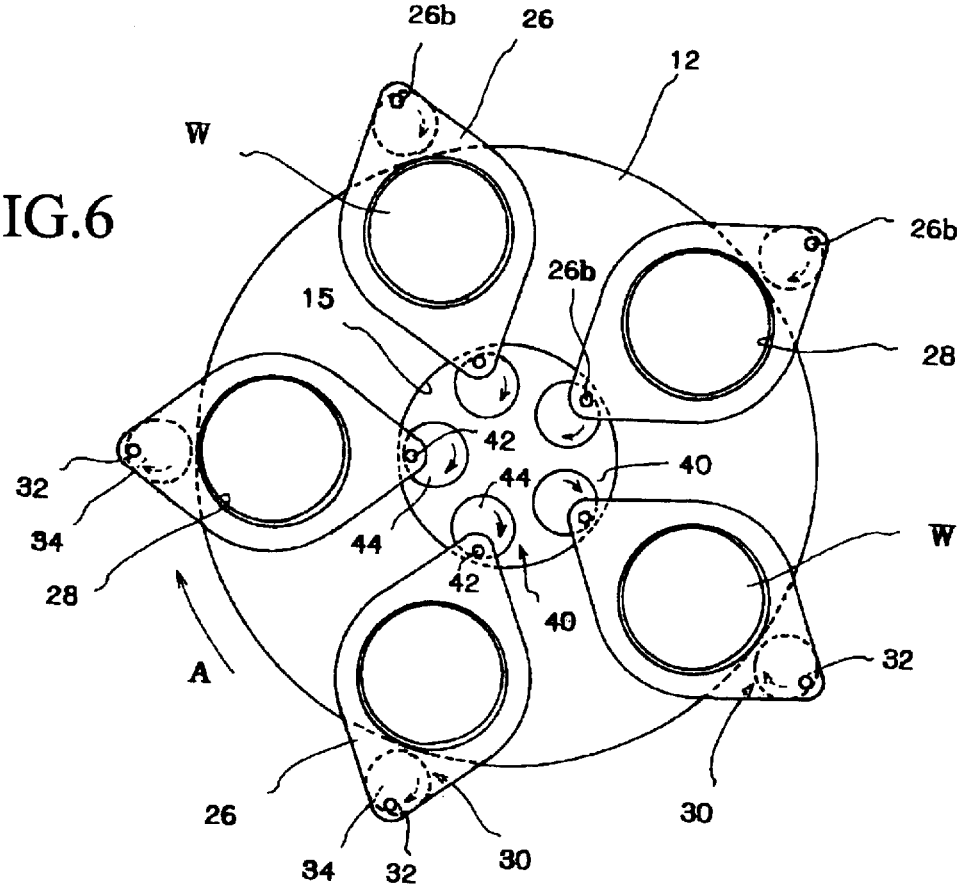
FIG. 6 is a plan view of carriers provided on the lower polishing plate.
Figure 16:
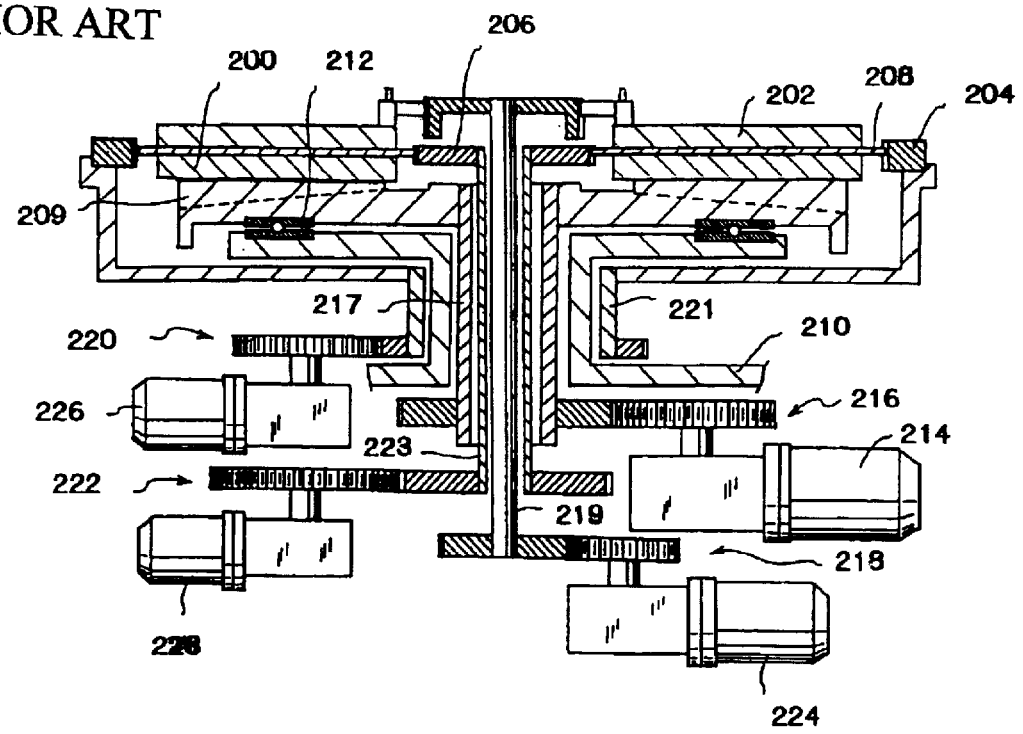
FIG.16 PRIOR ART
FIG. 16 is a schematic view of the conventional polishing machine.

Note that, in the example shown in FIG. 6, the eccentric arms 34 and 44 rotate in the clockwise direction at the same rotational speed. Therefore, the carriers 26, which are connected with the eccentric arms 34 and 44 by the connecting pins 32 and 42, can perform the small circular motion, without orbiting, in the clockwise direction.

Figure 7A:
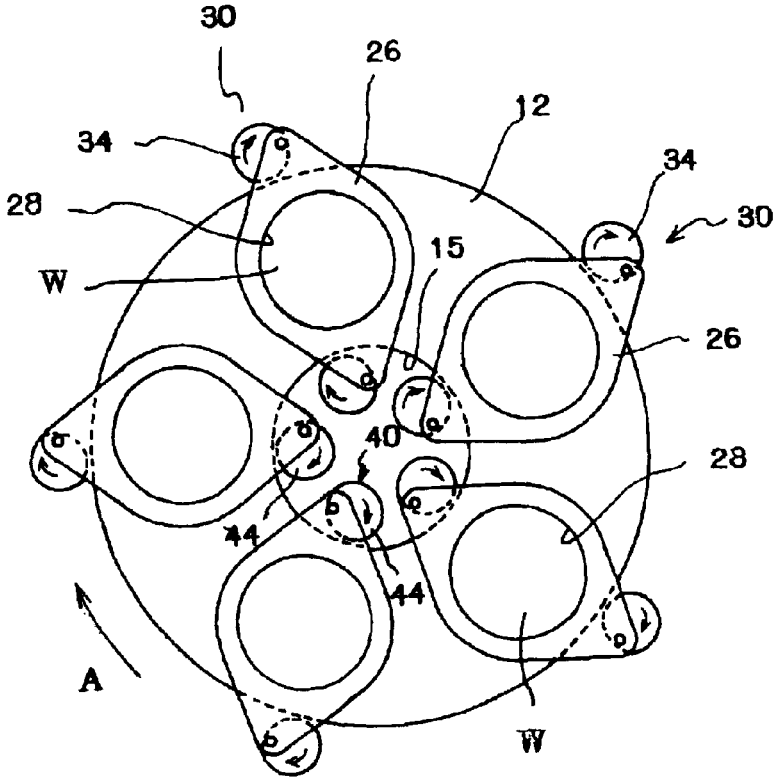
FIGS. 7A and 7B are explanation views showing motion of the carriers shown in FIG. 6.

For example, the carriers 26 connected with the eccentric arms 34 and 44 are rotated in the clockwise direction and simultaneously moved toward the center of the lower polishing plate 12 (See FIG. 7A). Therefore, the work pieces "W" held in the through-holes 28 of the carriers 26 are moved close to the inner edge of the donut-shaped lower polishing plate 12 (see FIG. 7B).

By further rotating the eccentric arms 34 and 44 in the clockwise direction, the carriers 26 rotate in the clockwise direction and simultaneously moved toward the outer edge of the lower polishing plate 12, so that the work pieces "W" held in the through-holes 28 of the carriers 26 are moved close to the outer edge of the lower polishing plate 12.

The small circular motion of the carriers 26, without revolving their own axes, are synchronously performed, so that the distances from the center of gravity of the upper polishing plate 10 to the centers of gravity of the work pieces "W" held in the through-holes 28 of the carriers 26 are equal. The center of gravity of the upper polishing plate 10 corresponds to the rotational axis of the lower polishing plate 12.

Therefore, a pressing force can be evenly applied to the work pieces "W" while polishing them between the polishing plates 10 and 12.

By evenly applying the pressing force, the problems of the conventional polishing machines, e.g., uneven polishing, generating vibrations, low polishing accuracy, can be solved.

In the polishing machine shown in FIG. 1, the second control section 98 controls the servo motors 70 and 80, and the performing means 30 and 40 for each carrier 26 are orbited round the rotational axis of the lower polishing plate 12, so that the work pieces "W" held in the through-holes 28 of the carriers 26 are also orbited round the rotational axis of the lower polishing plate 12. Therefore, conditions of the polishing faces of the polishing plates 10 and 12 do not influence polishing accuracy, so that the work pieces "W" can be polished with high polishing accuracy.

After completion of polishing the work pieces "W", the rotation of the upper polishing plate 10 is stopped, then the upper polishing plate 10 is moved upward so as to take out the polished work pieces "W". At that time, the second control section 98 controls the servo motors 70 and 80, and, the performing means 30 and 40 for each carrier 26 are orbited round the rotational axis of the lower polishing plate 12, so that the carriers 26 are also orbited round the rotational axis of the lower polishing plate 12. When the predetermined carrier 26 reaches a take-out position, the orbital movement of the carriers 26 is stopped.

At the take-out position, the polished work piece "W" held in the predetermined carrier 26 is taken out, then the carriers 26 are orbited again until the next carrier 26 holding the polished work piece "W" reaches the take-out position. This action is repeated until all the work pieces "W" are taken out from the carriers 26.

In the above description, both of the upper polishing plate 10 and the lower polishing plate 12 are rotated to polish the work pieces "W".

In another embodiment, the work pieces "W" may be polished between the upper polishing plate 10, which is not rotated, and the lower polishing plate 12, which is rotated. In this case, the carriers 26 must be orbited round the rotational axis of the lower polishing plate 12 while polishing the work pieces "W".

By driving the servo motors 70 and 80, the plates 72 and 84 are rotated, so that the orbital movement of the carriers 26 can be executed. At that time, the second control section 98 controls the motors 70 and 80 to orbit the performing means 30 and 40, which are provided for each carrier 26, round the rotational axis of the lower polishing plate 12. The second control section 98 controls rotational speeds of the plates 72 and 84, too.

By orbiting the carriers 26 holding the work pieces "W" while polishing, the upper polishing plate 10 need not be rotated, so the means 99 for rotating the upper polishing plate 10 can be omitted. Namely, the structure of the polishing machine can be simple.

The carrier 26 shown in FIGS. 2A and 2B is made of epoxy resin including glass fibers as a reinforcing material. As described above, the extended sections 26*a* are rightwardly and leftwardly extended from the through-hole 28, and the small holes 26*b* are respectively formed in the extended sections 26*a*.

Figure 8:
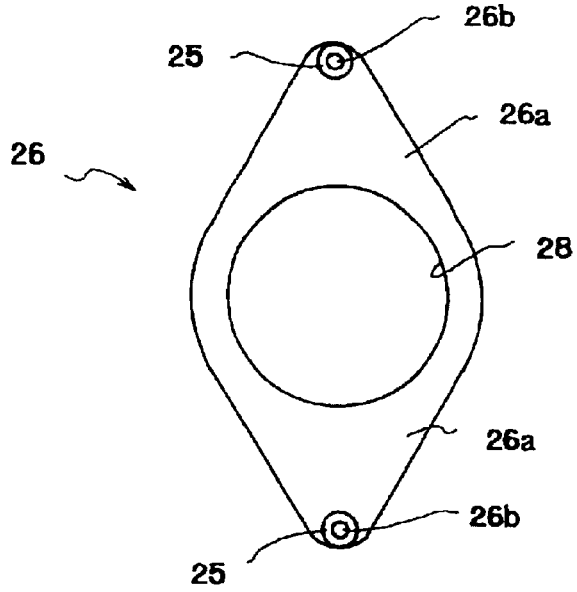
FIG. 8 is a front view of another carrier employed in the polishing machine shown in FIG. 1.
Figure 9A:
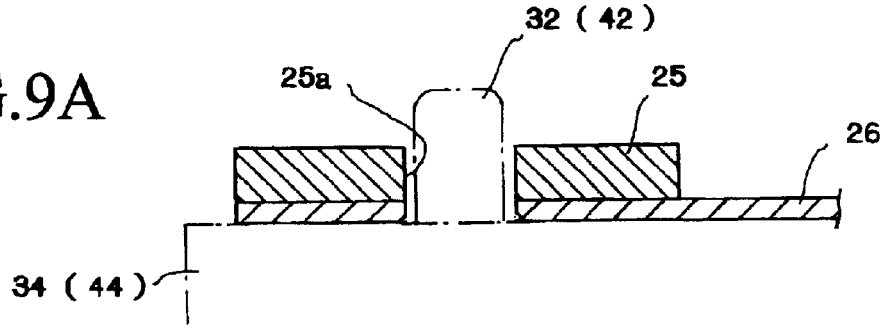
FIGS. 9A and 9B are partial sectional views of the carrier shown in FIG. 8.

To easily handle the carriers 26, they are made thin and light. However, if the connecting pins 32 and 42 are inserted in the small holes 26*b* of the thin carriers 26 and the eccentric arms 34 and 44 are rotated, inner edges of the small holes 26*b* are sometimes damaged by the connecting pins 32 and 42, or outer circumferential faces of the connecting pins 32 and 42 are sometimes damaged by the inner edges of the small holes 26*b*. To solve the problem, reinforcing plates 25, each of which has a through-hole 25*a* whose diameter is equal to that of the small hole 26*b*, may be adhere on the carrier 26 (see FIGS. 8 and 9A). By the reinforcing plates 25, the inner edges of the small holes 26*b* can be reinforced, so that they are not damaged by the connecting pins 32 and 42 inserted there through.

Since the outer circumferential faces of the connecting pins 32 and 42 contact inner circumferential faces of the small holes 26*b* and the through-holes 25*a*, shock of contacting the both faces can be scattered, so that the damage of the inner edges of the small holes 26*b* and the outer circumferential faces of the connecting pins 32 and 42 can be prevented.

Figure 9B:
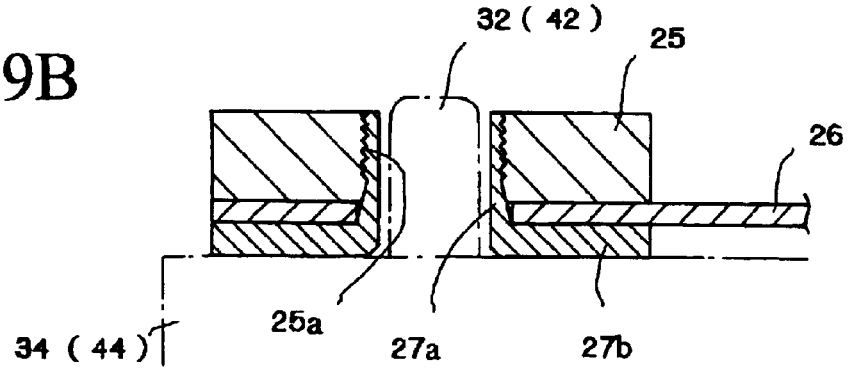

Further, as shown in FIG. 9B, the inner circumferential faces of the small hole 26*b* and the through-hole 25*a*, which contact the connecting pins 32 (or 42), may be reinforced by inserting and fixing cylindrical member 27*a* in the both holes 26*b* and 25*a*. In an example shown in FIG. 9B, the reinforcing plate 25, whose through-hole 25*a* is a female screw hole, is previously adhered on an upper face of the carrier 26. The cylindrical member 27*a* is upwardly extended from a flange section 27*b*, and a male screw is formed on an outer circumferential face thereof. The cylindrical member 27*a* is inserted into the small hole 25*a* from a bottom side of the carrier 26 and screwed with the female screw hole 25*a* of the reinforcing plate 25. With this structure, the inner faces and the inner edges of the small holes 26*b* can be reinforced.

Figure 7B:
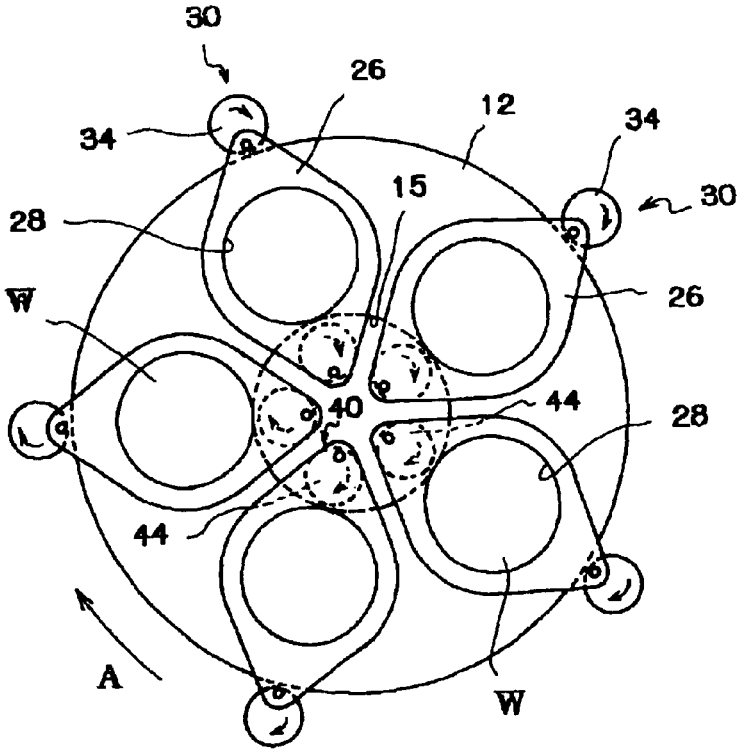

In the polishing machine shown in FIGS. 6, 7A and 7B, an odd number of the carriers 26 are provided on the lower polishing plate 12. On the other hand, in the polishing machine shown in FIG. 10, an even number of the carriers 26 are provided on the lower polishing plate 12. In this case too, a pair of the performing means 30 and 40 are required for each carrier 26.

Figure 10:
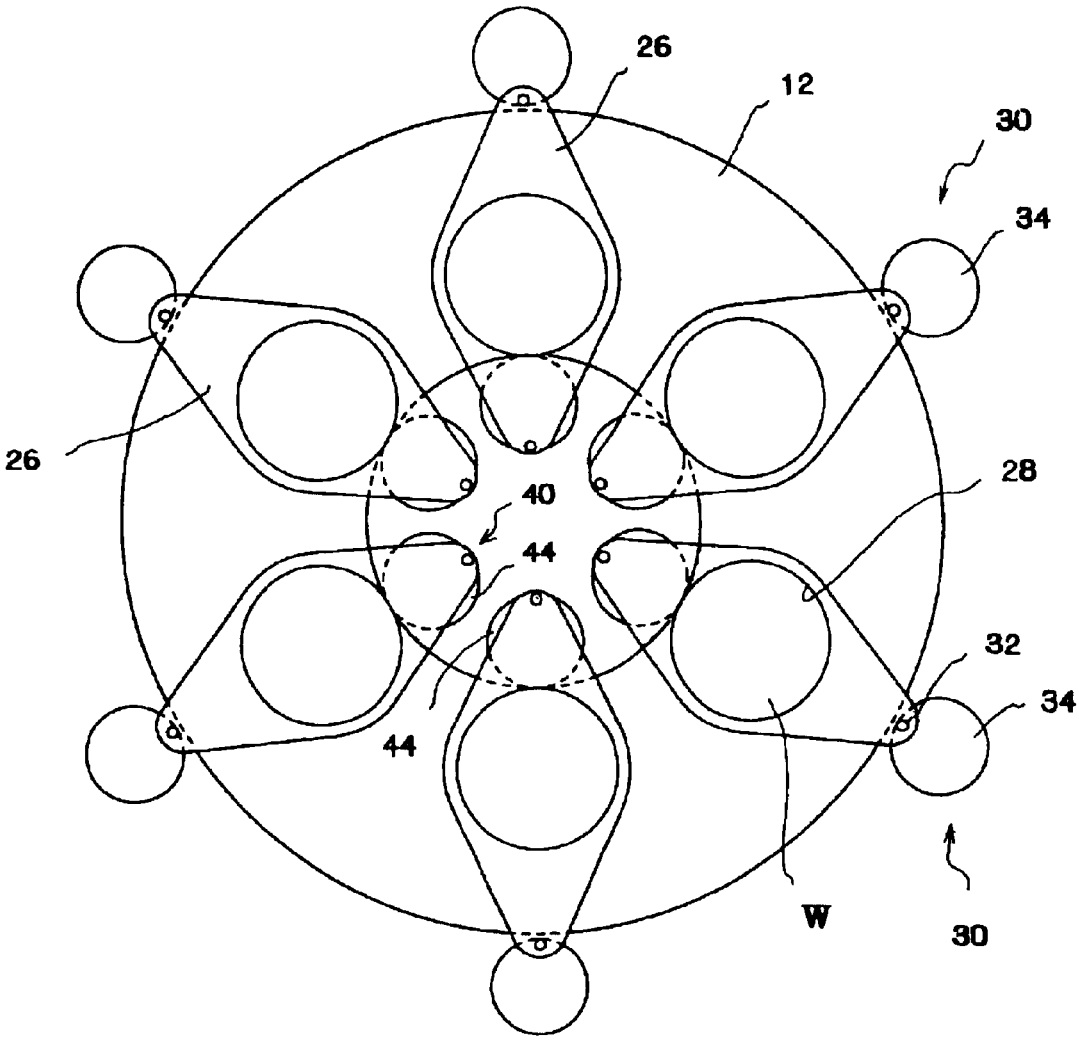
FIG. 10 is a plan view of other carriers provided on the lower polishing plate.
Figure 11:
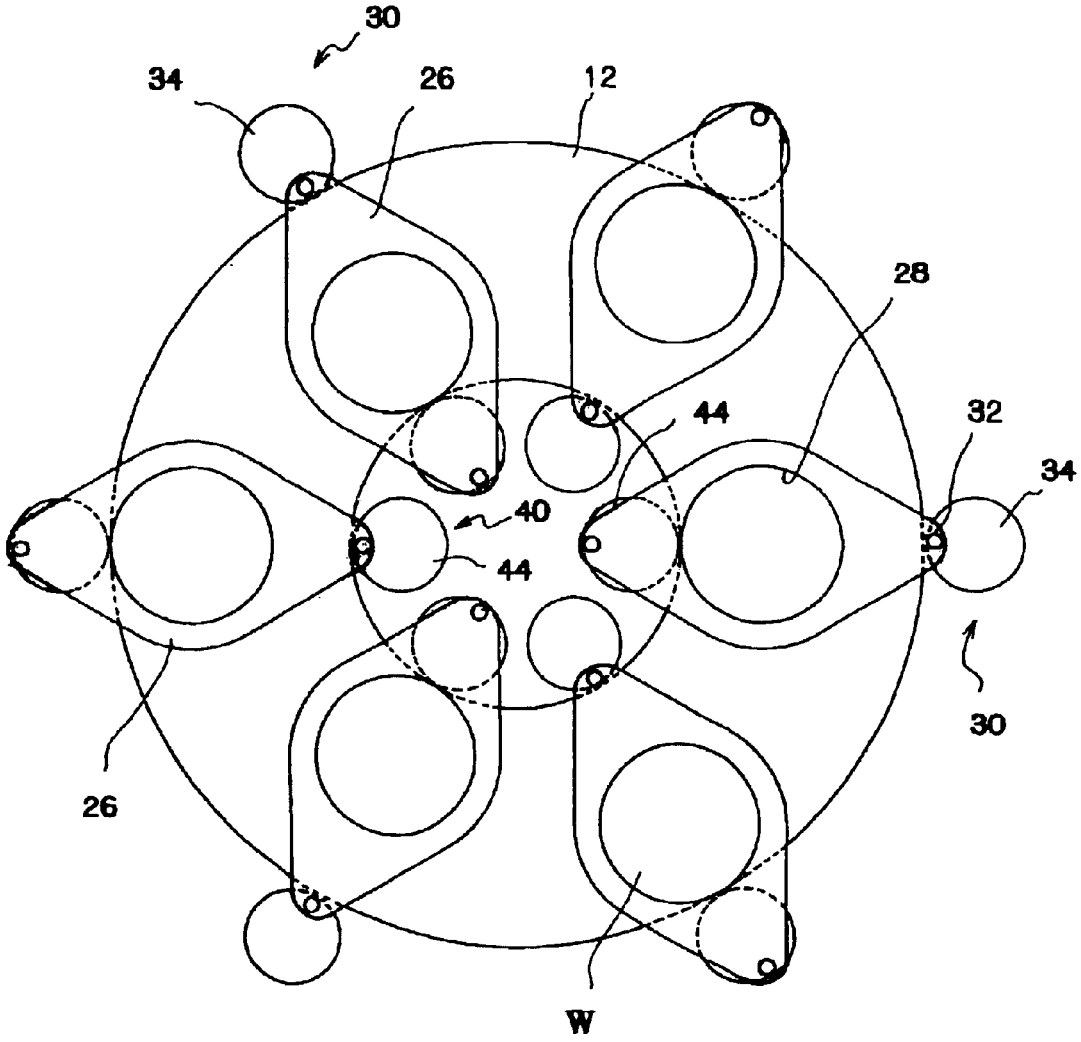
FIG. 11 is a plan view of other carriers provided on the lower polishing plate.

In FIG. 10, phases of the small circular motion of the carriers 26 are same. On the other hand, in the polishing machine shown in FIG. 11, phases of the circular motion of the adjacent carriers 26 are shifted 180 degrees. Since an even number of the carriers 26 are provided, the carriers 26 whose phases of the circular motion are mutually same are alternately arranged. With this arrangement, the carriers 26 can be mutually balanced. Further, in this case, the distances from the center of gravity of the upper polishing plate 10 to the centers of gravity of the work pieces "W" held in the carriers 26, whose phases of the circular motion are same, are equal. The center of gravity of the upper polishing plate 10 corresponds to the rotational axis of the lower polishing plate 12.

In each of the polishing machines shown in FIGS. 1–11, the carriers 26 provided on the lower polishing plate 12 perform the small circular motion. The performing means 40, which are arranged along the inner edged of the center hole 15 of the lower polishing plate 12, should be provided for each carrier 26. Therefore, if a number of the carriers 26 is increased, the center hole 15 must be broadened so as to install the increased number of the performing means 40 therein. However, the upper polishing plate 10 and the lower polishing plate 12 must have the polishing faces having prescribed area, so the polishing plates 10 and 12 must be large with broadening the center hole 15. To include the large polishing plates 10 and 12, the polishing machine must be large in size.

Figure 12A:
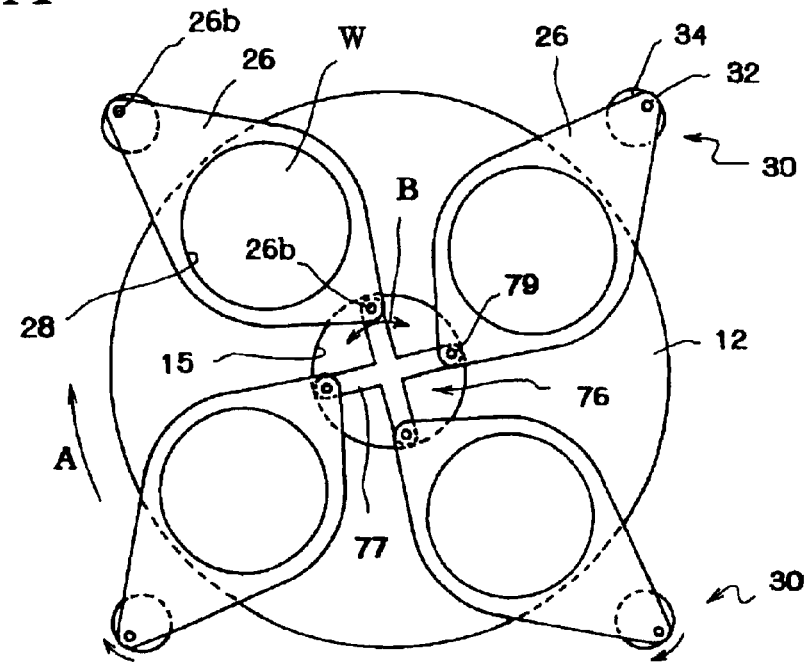
FIGS. 12A and 12B are plan views of the polishing machine of another embodiment of the present invention.

To solve this problem, a polishing machine shown in FIG. 12A has a swing mechanism 76 provided in the center hole 15 of the lower polishing plate 12. Unlike the polishing machine having a plurality of the performing means 40 provided in the center hole 15, the center hole 15 can be small in size.

A plurality of swing arms 77, which swing in directions "B" are included in the swing mechanism 76. Number of the swing arms 77 is equal to that of the carriers 26 provided on the lower polishing plate 12. Second connecting pins 79, each of which is inserted in the small hole 26*b* of the carrier 26, are respectively provided to front ends of the swing arms 77.

A plurality of performing means 30 are arranged along the outer edge of the lower polishing plate 12. Each performing means 30 corresponds to each carrier 26 as well as the foregoing embodiments.

By adjusting swing speeds of the swing arms 77 and rotational speeds of the eccentric arms 34, swing motion of the carriers 26 can be performed.

When the work pieces "W", which are accommodated and held in the through-holes 28, are located close to the outer edge of the lower polishing plate 12 rotating in a direction "A" (see FIG. 12A), the eccentric arms 34 of the performing means 30 are rotated in the clockwise direction, and the swing arms 77 of the swing mechanism 76 are turned in the clockwise direction. At that time, the work pieces "W" held by the carriers 26 are moved toward the center hole 15 and simultaneously moved in the clockwise direction. When the clockwise turn of the swing arms 77 are stopped, the work pieces "W" are located close to the inner edge of the center hole 15 of the lower polishing plate 12 (see FIG. 12B).

Then, the swing arms 77 of the swing mechanism 76 are turned in the counterclockwise direction, and the eccentric arms 34 are continuously rotated in the clockwise direction. When the counterclockwise turn of the swing arms 77 are stopped, the work pieces "W" are located close to the outer edge of the lower polishing plate 12 (see FIG. 12A).

Figure 12B:
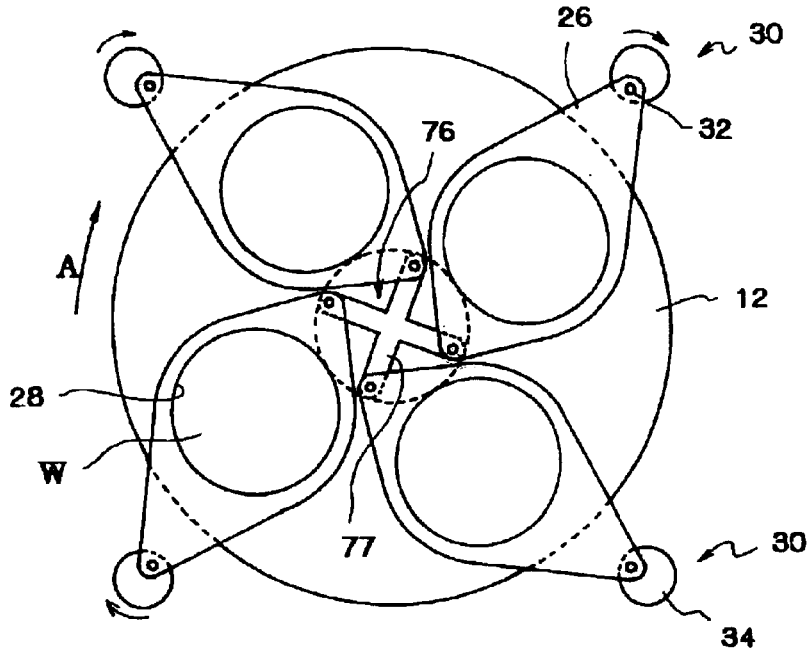

Since the carriers 26 are synchronously moved, the distances from the center of gravity of the upper polishing plate 10 to the centers of gravity of the work pieces "W" held in the through-holes 28 of the carriers 26 are equal, and the center of gravity of the upper polishing plate 10 corresponds to the rotational axis of the lower polishing plate 12 (see FIGS. 12A and 12B).

Therefore, the pressing force from the polishing plate 10 can be evenly applied to the work pieces "W", which are polished between the polishing plates 10 and 12.

Figure 13A:
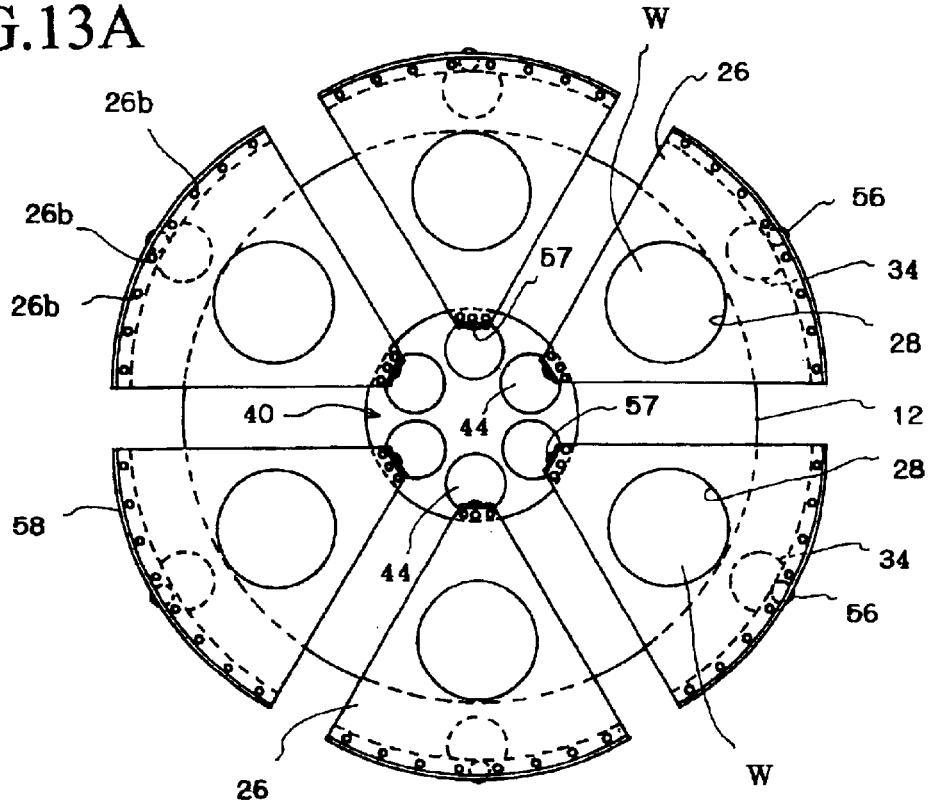
FIGS. 13A and 13B are plan views of the polishing machine of another embodiment of the present invention.
Figure 13B:
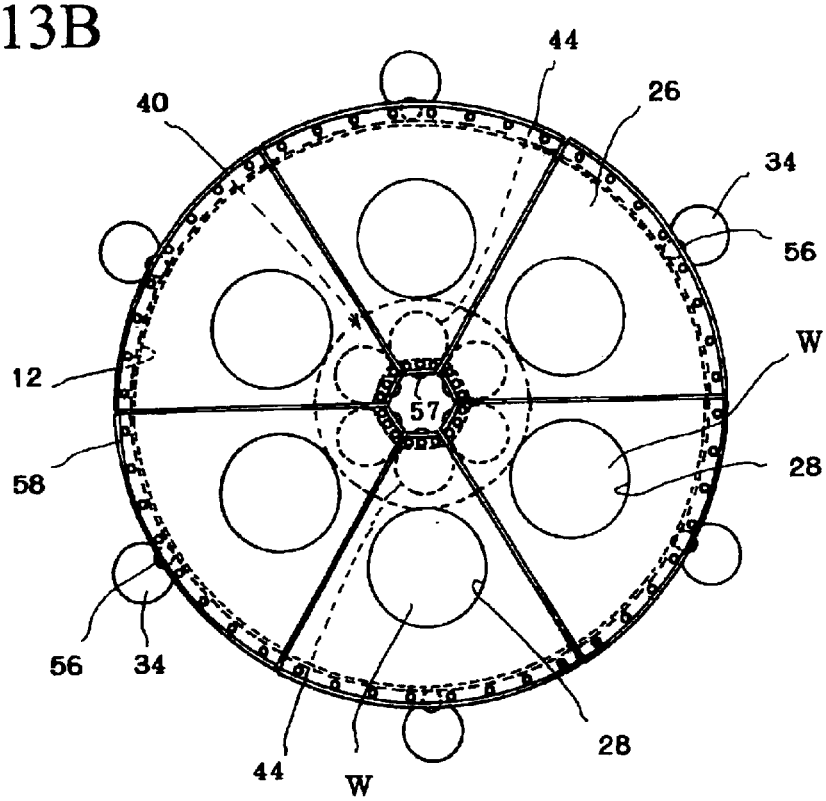

In the above described embodiments, the carrier 26 is formed into the diamond shape, but it may be formed into a sector or fan shape (see FIGS. 13A and 13B).

In FIG. 13A, the work pieces "W" held in the through-holes 28 of the sector-shaped carriers 26 are located close to the outer edge of the lower polishing plate 12; in FIG. 13B, the work pieces "W" held in the through-holes 28 of the sector-shaped carriers 26 are located close to the inner edge of the lower polishing plate 12. Note that, in FIGS. 13A and 13B, the structural elements shown in FIGS. 1–12B are assigned the same symbols, and explanation of them will be omitted.

Figure 14:
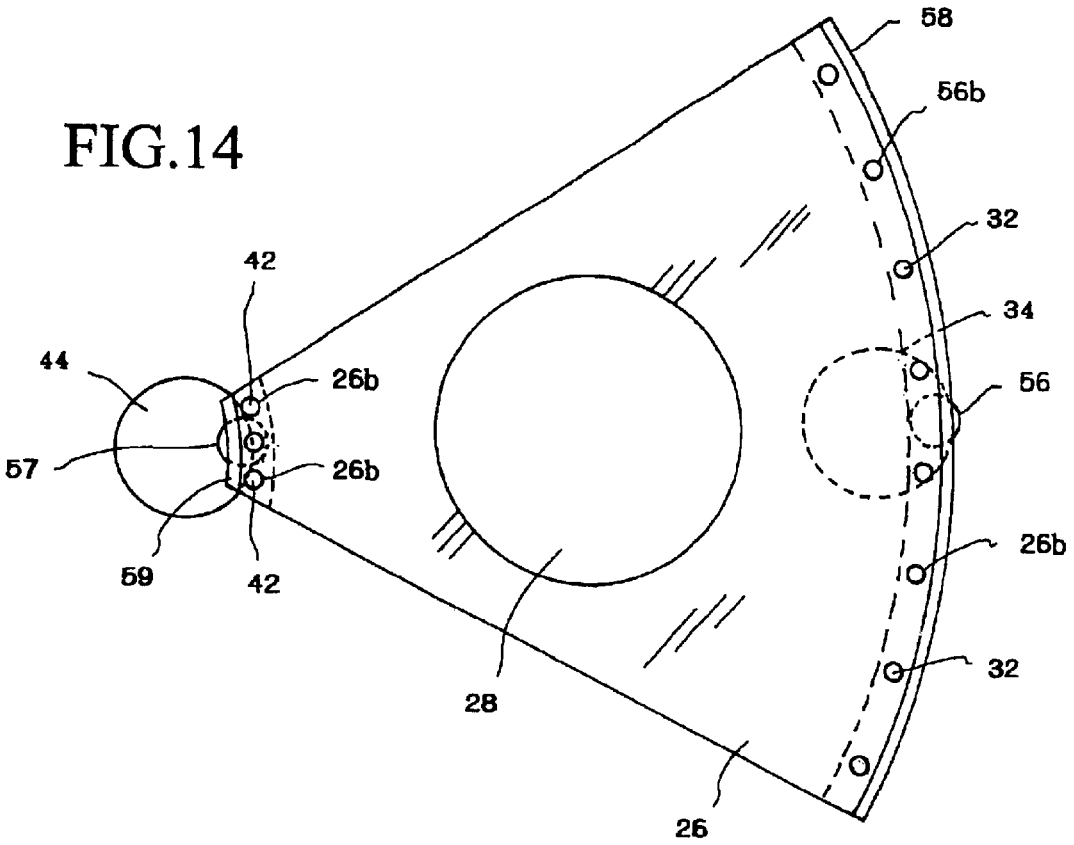
FIG. 14 is a front view of the carrier shown in FIGS. 13A and 13B.

Enlarged view of the sector-shaped carrier 26 is shown in FIG. 14. The through-hole 28 for accommodating the work piece "W" is formed at a center part. The small holes 26*b* are formed along an inner edge and an outer edge of the sector-shaped carrier 26.

Figure 15:
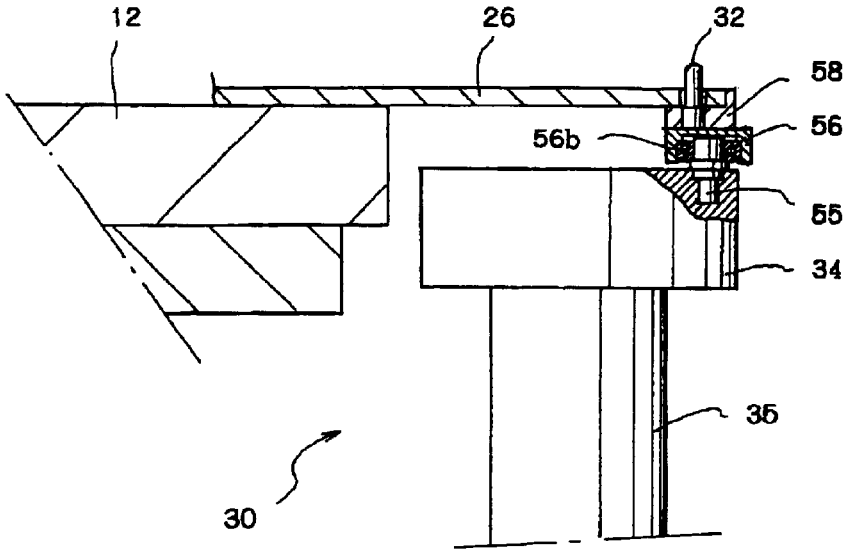
FIG. 15 is a partial sectional view of the carrier shown in FIGS. 13A and 13B.
Figure 18:
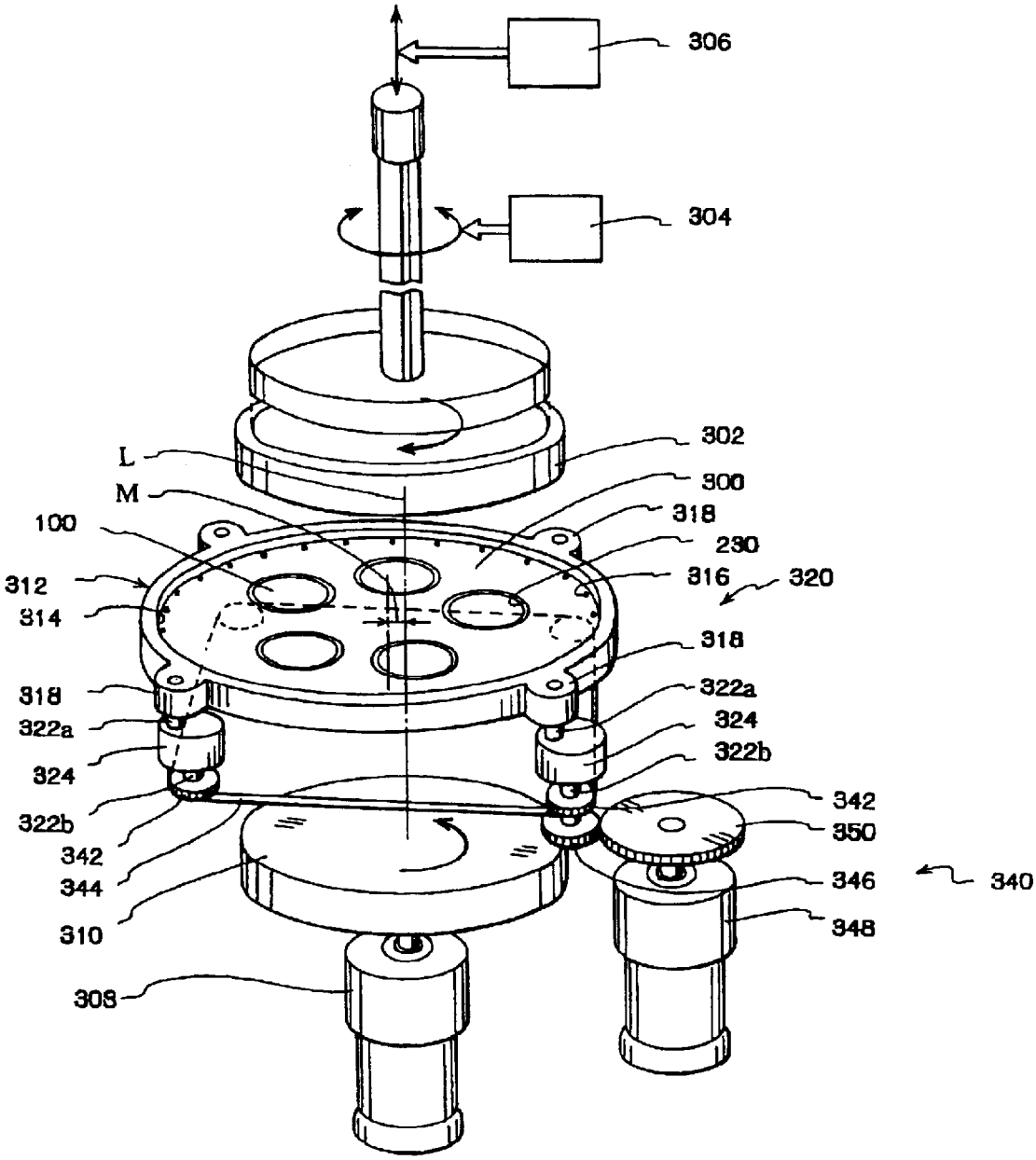
FIG.18 PRIOR ART
FIG. 18 is a schematic view of another conventional polishing machine.

The connecting pins 32 shown in FIG. 15 are respectively inserted into the small holes 26*b* arranged along the outer edge. The connecting pins 32 are provided to a band-shaped member 58, which are arranged along the outer edge of the carrier 26. The connecting pins 32 correspond to the small holes 26*b* arranged along the outer edge of the carrier 26.

As shown in FIG. 15, the band-shaped member 58 is formed into an L-shape in section and fixed to a circular disk 56, which is rotatably attached to a pin 55 with a bearing 56*b*. The pin 55 is eccentrically provided to the circular eccentric arm 34.

As shown in FIG. 14, the connecting pins 42 are respectively inserted into the small holes 26*b* arranged along the inner edge. The connecting pins 42 are provided to a band-shaped member 59, which are arranged along the inner edge of the carrier 26. The connecting pins 42 correspond to the small holes 26*b* arranged along the inner edge of the carrier 26. The band-shaped member 59 is formed into an L-shape in section and fixed to a circular disk 57, which is rotatably attached to a pin, which is eccentrically provided to the circular eccentric arm 44, with a bearing.

In the polishing machine having the sector-shaped carriers 26 shown in FIGS. 13A–15, when the eccentric arms 34 and 44 are rotated in the clockwise direction at the same speed (see FIGS. 6–7B), the carriers 26 connected by the connecting pins 32 of the band–shaped members 58 and 59 perform the small circular motion, in the clockwise direction, without orbiting.

Since the connecting pins 32 and 42 are inserted in the small holes 26*b* arranged along the inner and the outer edges of the carrier 26, an external force is applied to the carrier 26 via the connecting pins 32 and 42, so that the external force is scattered. Therefore, unlike the carrier 26 engaged with one connecting pin 32 and one connecting pin 42, damage of the carrier 26 can be prevented; no reinforcing means 25 (see FIGS. 8–9B) are provided to the small holes 26*b*. Of course, the reinforcing means 25 may be employed to further reinforce the carriers 26.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. A polishing machine, comprising:

an upper polishing plate for polishing upper faces of work pieces;

a lower polishing plate for polishing lower faces of the work pieces;

means for rotating at least one of said polishing plates;

a plurality of carriers being provided around a center of gravity of said upper polishing plate and sandwiched between said polishing plates, each of said carriers having a through-hole, in which the work piece is accommodated;

means for independently performing circular motion or swing motion of said carriers without revolving on their own axes; and means for controlling said performing means, whereby centers of gravity of the work pieces, which are held by said carriers, are simultaneously moved close to a center of gravity of said upper polishing plate and simultaneously moved away therefrom, and moving distances of the centers of gravity of the work pieces are equal while the circular motion or the swing motion of said carriers.

2. The polishing machine according to claim 1, further comprising means for orbiting said carriers round a rotational axis of said lower polishing plate, wherein said rotating means rotates the both of said polishing plates.

3. The polishing machine according to claim 1, wherein said performing means is located close to said lower polishing plate, and connecting sections, which are respectively formed in extended sections of said carriers projected from an outer edge of said lower polishing plate, are respectively connected with connecting members of said performing means.

4. The polishing machine according to claim 1, wherein said lower polishing plate has a donut-shape with a center hole, a couple of said performing means are respectively located close to an inner circumferential face of the center hole of said lower polishing plate and an outer circumferential face of said lower polishing plate, and connecting sections, which are formed in said carriers and located close to the inner circumferential face and the outer circumferential face of said lower polishing plate, are respectively connected with connecting members of said performing means.

5. The polishing machine according to claim 1, wherein said performing means includes eccentric arms, which are rotatable and in each of which a connecting pin connected with said carrier is eccentrically provided.

6. The polishing machine according to claim 1, wherein said performing means includes:

eccentric arms, which are rotatable and in each of which a first connecting pin connected with said carrier is eccentrically provided; and swing arms, which are swingable and in each of which a second connecting pin is connected with said carrier at a position separated from said first connecting pin.

7. The polishing machine according to claim 1, wherein phases of the circular motion or the swing motion of said carriers provided to said lower polishing plate are same.

8. The polishing machine according to claim 1, wherein an even number of said carriers are provided to said lower polishing plate, and phases of the circular motion or the swing motion of said adjacent carriers are shifted 180 degrees.

9. The polishing machine according to claim 1, wherein each of said carriers has a plurality of the through-holes.

10. The polishing machine according to claim 1, wherein each of said carriers is formed into a diamond shape or a sector shape.

11. A polishing machine, comprising:

a fixed upper polishing plate for polishing upper faces of work pieces;

a rotatable lower polishing plate for polishing lower faces of the work pieces;

means for rotating said lower polishing plate;

a plurality of carriers being provided around a center of gravity of said upper polishing plate and sandwiched between said polishing plates, each of said carriers having a through-hole, in which the work piece is accommodated;

means for independently performing circular motion or swing motion of said carriers without revolving on their own axes;

means for orbiting said carriers round a rotational axis of said lower polishing plate; and means for controlling said performing means, whereby centers of gravity of the work pieces, which are held by said carriers, are simultaneously moved close to a center of gravity of said upper polishing plate and simultaneously moved away therefrom, and moving distances of the centers of gravity of the work pieces are equal while the circular motion or the swing motion of said carriers.

12. The polishing machine according to claim 11, wherein said performing means is located close to said lower polishing plate, and connecting sections, which are respectively formed in extended sections of said carriers projected from an outer edge of said lower polishing plate, are respectively connected with connecting members of said performing means.

13. The polishing machine according to claim 11, wherein said lower polishing plate has a donut-shape with a center hole, a couple of said performing means are respectively located close to an inner circumferential face of the center hole of said lower polishing plate and an outer circumferential face of said lower polishing plate, and connecting sections, which are formed in said carriers and located close to the inner circumferential face and the outer circumferential face of said lower polishing plate, are respectively connected with connecting members of said performing means.

14. The polishing machine according to claim 11, wherein said performing means includes eccentric arms, which are rotatable and in each of which a connecting pin connected with said carrier is eccentrically provided.

15. The polishing machine according to claim 11, wherein said performing means includes:

eccentric arms, which are rotatable and in each of which a first connecting pin connected with said carrier is eccentrically provided; and swing arms, which are swingable and in each of which a second connecting pin is connected with said carrier at a position separated from said first connecting pin.

16. The polishing machine according to claim 11, wherein phases of the circular motion or the swing motion of said carriers provided to said lower polishing plate are same.

17. The polishing machine according to claim 11, wherein an even number of said carriers are provided to said lower polishing plate, and phases of the circular motion or the swing motion of said adjacent carriers are shifted 180 degrees.

18. The polishing machine according to claim 11, wherein each of said carriers has a plurality of the through-holes.

19. The polishing machine according to claim 11, wherein each of said carriers is formed into a diamond shape or a sector shape.

* * * * *